United States Patent [19]

Vicars et al.

[11] Patent Number: 4,798,556

[45] Date of Patent: Jan. 17, 1989

[54] ARTICLE HAVING A CHANGEABLE-EXPRESSION FACE

[75] Inventors: Paul D. Vicars, Fairborn, Ohio; Roy J. Hendricks, Fairfax, Va.; Eugene F. Goubeaux, Jr., Dayton, Ohio

[73] Assignee: U.S. Creative Concepts, Fairborn, Ohio

[21] Appl. No.: 891,787

[22] Filed: Jul. 30, 1986

[51] Int. Cl.[4] ..... A63H 3/36; A63H 3/38

[52] U.S. Cl. ..... 446/391; 446/392; 446/395

[58] Field of Search ..... 446/268, 321, 369, 391, 446/392, 395, 100, 152

[56] References Cited

U.S. PATENT DOCUMENTS

| | | | |
|---|---|---|---|
| 1,340,512 | 5/1920 | Wild | 446/100 |
| 1,535,925 | 4/1925 | Lee | 446/100 |
| 2,019,516 | 11/1935 | Weinberg | 446/392 |
| 3,210,884 | 10/1965 | Sharff et al. | 446/100 |
| 3,811,220 | 5/1974 | Glass et al. | 446/321 |
| 3,871,128 | 3/1975 | Grooms | 446/372 |
| 4,122,628 | 10/1978 | Crowell et al. | 446/100 |
| 4,309,839 | 1/1982 | White et al. | 446/152 |
| 4,629,441 | 12/1986 | Cahill | 446/392 |

*Primary Examiner*—Robert A. Hafer
*Assistant Examiner*—Michael Brown
*Attorney, Agent, or Firm*—Becker & Becker, Inc.

[57] ABSTRACT

An article having a changeable-expression face. The article includes a facing plate and facial components, such as a mouth, nose, and eyes, that are rotatably mounted on the facing plate. A securing part of the facial components extends through the facing plate and is secured on the back side of the latter by a fastening mechanism. A backing plate is secured to the back of the facing plate to cover the securing parts and fastening mechanisms.

14 Claims, 2 Drawing Sheets

ARTICLE HAVING A CHANGEABLE-EXPRESSION FACE

BACKGROUND OF THE INVENTION

1. Field of the Invention

This invention relates to a changeable mood face for stuffed plush fabric character playthings and other articles, and more particularly to a face on which the mood can be changed by simply manipulating (rotating) the eyes, nose, and mouth. These facial features may, by rotating them, be arranged in an infinite number of positions creating differing facial moods or expressions.

2. Description of Prior Art

No known embodiments of similar concepts have been disclosed.

SUMMARY OF THE INVENTION

The present invention provides an article that has rotatable facial features (eyes, nose, and mouth) mounted, for example, on a stuffed plush fabric face or other facing plate material by means of dowels and locking star washers or other securing parts or fastening devices. These features may be rotated about the dowel axis so as to change the position of the feature relative to the curve of the mouth, vertical line of the nose, and the pupil of the eye, so as to modify the mood or expression of the face. This ability to manipulate the facial features by hand permits the user of the plaything or other article to create an infinite number of facial variations.

BRIEF DESCRIPTION OF THE DRAWINGS

Exemplary embodiments of the present invention will be described in detail in conjunction with the accompanying drawings, in which.

The changeable mood face can be applied to any of a variety of stuffed fabric characters, animals, playthings, and other articles. Four facial components constructed of plastic or other type material could be provided, including: two eyes, a nose, and a mouth, each of which is constructed with a dowel perpendicular to the plane of the facial component, such that the facial component may be attached to the facing plate by inserting the dowel through holes in the facing plate. Four flat washers may optionally be applied over the dowels behind the facing plate to prevent wear of the facing plate material. The facial components are secured in place by means of four star washers, one of which is locked over each of the dowels to secure each of the facial components in place. Alternate means of securing the facial components can be used. For example, in the case of plastic features, the dowels may be softened by heat and deformed to a rivet type head larger than the hole in the flat washer so that it cannot be pulled through the flat washer. Also in the case of plastic features made of polyvinyl chloride (PVC) type plastic, a PVC washer or tube could be affixed over the dowel with PVC cement. In the case of metal facial components, the dowels may be hammered to a rivet type head. In any case, the facial component are clearly not detachable.

DESCRIPTION OF PREFERRED EMBODIMENTS

Figure 2:
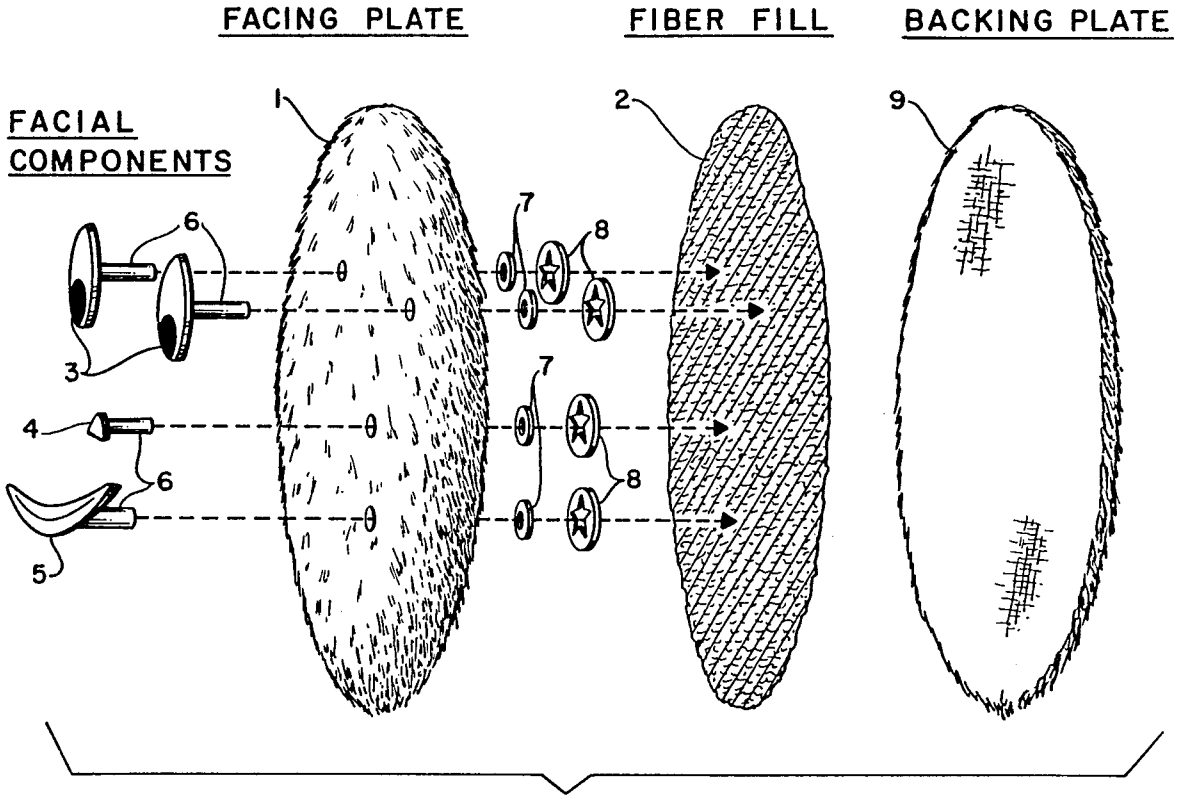
FIG. 2 is an exploded view of the article of FIG. 1.
Figure 1:
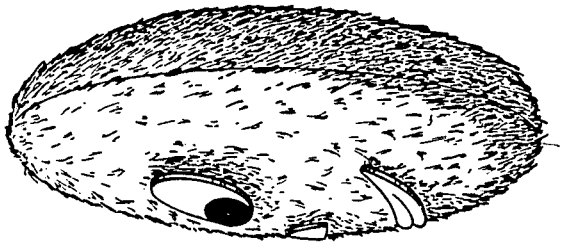
FIG. 1 schematically illustrates one exemplary embodiment of the inventive changeable-expression article.

One specific embodiment of the changeable mood or expression face is shown in FIGS. 1 and 2, and is on a plush fiber filled fabric puff which is described by the name "Mood Puff", and comprises the face assembly for a stuffed plush or other fabric character. This face assembly includes a facing plate 1 backed by a fiber fill 2. The rotatable facial components, namely eyes 3, nose 4, and mouth 5, are provided with perpendicular dowels 6. These dowels 6, which form a securing part for the facial components 3–5, extend through the facing plate 1, e.g. through holes provided in the latter, and are secured by locking star washers 8. It would also be possible, if desired, to place respective flat backing washers 7 between each star washer 8 and the back of the backing plate 1. The star washers 8 are snugged up enough to prevent the facial features or components 3–5 from appearing loose and from being pulled out, but leave enough clearance to permit easy rotation of the features. The puff is then enclosed by attaching the backing plate 9.

Figure 3:
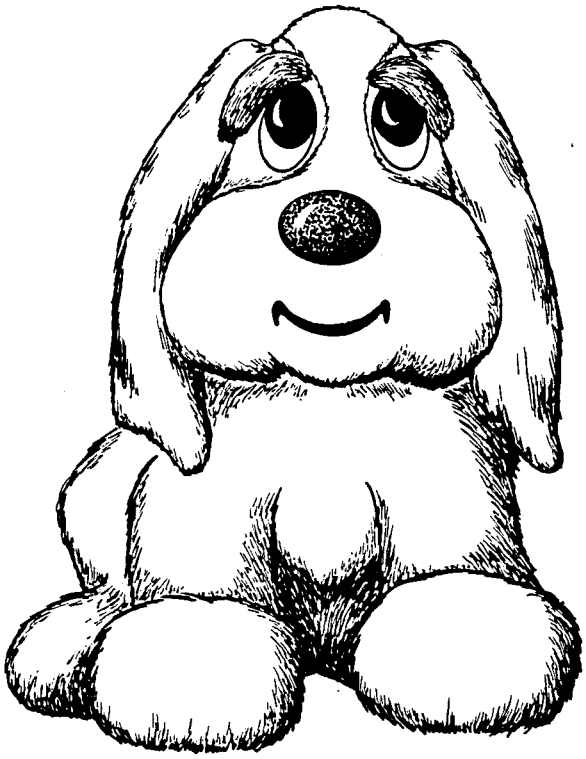
FIGS. 3 to 6 show further exemplary embodiments of the inventive article, each with a different expression.
Figure 4:
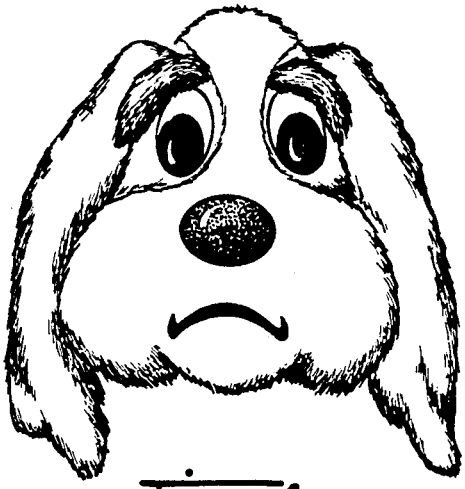
Figure 5:
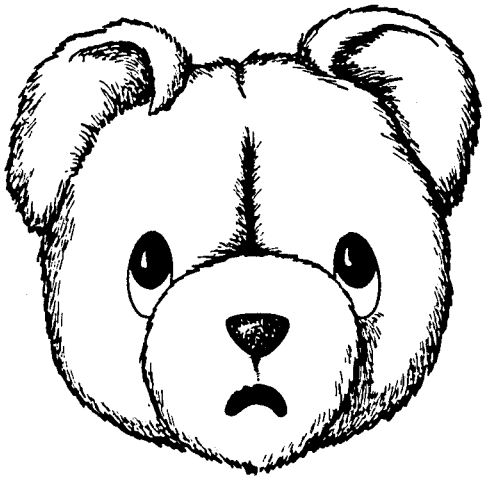
Figure 6:
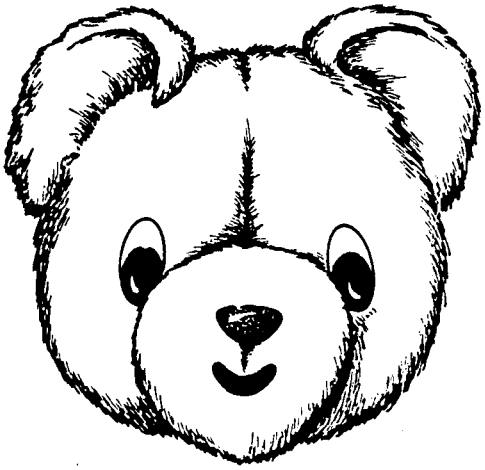

As will be evident from the drawings, descriptions, and claims, while the preferred embodiment is on a plush fiber filled, fabric puff, the changeable mood face can be applied to any of a vast number of stuffed fabric characters, animals, playthings, amusements, and other articles and items, which may be described by the general phrase, "Mood Products." For example, FIG. 3 shows an embodiment incorporated in a stuffed dog, while FIG. 4 shows another dog face, and FIGS. 5 and 6 shows bear faces.

The user may manually engage each of the facial components, and by rotating them about their perpendicular dowels, change the position thereof so as to:

a. change the direction of the curvature of the mouth relative to the center thereof and to the top, bottom, and sides of the face;

b. change the position of each eye so as to change the position of the pupil of each eye independently relative to the center thereof and to the top, bottom, and sides of the face;

c. change the position of the nose relative to the center thereof and to the top, bottom, and sides of the face.

When manually grasped and manipulated, i.e. rotated by the user, the changeable expression face will produce an infinite variety of moods and expressions, including but not limited to: innocence; despair; anger; unhappiness; zaniness; shyness; happiness; chagrin; devilishness; nosiness; and haughtiness.

The changeable-expression face may be applied to an infinite number of different toys, characters, stuffed animals, playthings, amusements, and other articles and items. The inventive article could even be embodied as a magnet that could be placed on a refrigerator, etc. for decoration. In such a case, the backing plate 9 would be made of magnetic material.

The present invention is, of course, in no way restricted to the specific disclosure of the specification and drawings, but also encompasses any modifications within the scope of the appended claims.

What is claimed is:

1. An article having a changeable-expression face, said article comprising:

a facing plate having a front side and a back side;

three facial components each independent moveable one component having a feature part with the appearance of a mouth, shaped to convey at least one mood disposition in one direction of movement for positioning thereof and also further mood dispositions in other direction of movement for positioning thereof, and two having a feature part with the appearance of an eye, that is offset from center positioning thereof said facial components being non-detachably rotatably mounted on said facing plate, with said facial components each having a feature part disposed on said front side on said facing plate, and a securing part that extends through said facing plate to said back side thereof, and whereby rotation of said facial components changes the expression of said article;

fastening means disposed on said securing parts of said facial components, remote from said front side of said facing plate, for providing non-detachable rotatable mounting of said facial components on said facing plate; and a backing plate secured to said facing plate in such a way as to cover said back side of the latter, said securing parts of said facial components, and said fastening means.

2. An article according to claim 1, in which the feature part of each of said facial components is substantially disposed in a first plane, and has the appearance of a facial feature.

3. An article according to claim 2, which includes a further facial component having a feature part with the appearance of a nose.

4. An article according to claim 2, in which said backing plate is made of magnetic material.

5. An article according to claim 2, in which said facial components project from said front side of said facing plate so that they can be manipulated manually to rotate them and thereby produce an infinite variety of moods and expressions.

6. An article according to claim 2, in which said securing part of each of said facial components is a dowel-like member that extends perpendicular to said first plane of said feature part of that facial component; and in which said facing plate is provided with holes through which said dowel-like members extend.

7. An article according to claim 6, in which said facial components are made of plastic.

8. An article according to claim 6, in which said fastening means are in the form of star washers, one of which is disposed on each of said dowel-like members.

9. An article according to claim 8, in which said facing plate and said backing plate are made of fabric.

10. An article according to claim 9, which includes a fiber filling that is disposed between, and is enclosed by, said facing plate and said backing plate.

11. An article according to claim 10, which includes a respective flat washer disposed on each of said dowel-like members between said back side of said facing plate and said star washer.

12. An article having a changeable-expression face, said article comprising:

a facing plate having a front side and a back side;

three facial components, each independently moveable one component having a feature part with the appearance of a mouth, shaped to convey at least one mood disposition in one direction of movement for positioning thereof and also further mood dispositions in other direction of movement for positioning thereof and two having a feature part with the appearance of an eye, that is offset from center positioning thereof being non-detachably rotatably mounted on said facing plate, with said facial components each having a feature part disposed on said front side of said facing plate, and a securing part that extends through said facing plate to said back side thereof, with said feature part of each of said facial components being substantially disposed in a first plane and having the appearance of a facial feature, and with said securing part of each of said facial components being a dowel-like member that extends perpendicular to said first plane of said feature part of that facial component; said facing plate is provided with holes through which said dowel-like members extend; and whereby rotation of said facial components changes the expression of said article;

fastening means disposed on said dowel-like members of said facial components, remote from said front side of said facing plate, for providing non-detachable rotatable mounting of said facial components on said facing plate; and a backing plate secured to said facing plate in such a way as to cover said back side of the latter, said dowel-like members of said facial components, and said fastening means.

13. An article according to claim 12, in which said fastening means are in the form of star washers, one of which is disposed on each of said dowel-like members.

14. An article according to claim 13, in which said facing plate and said backing plate are made of fabric, and a fiber filling that is disposed between, and is enclosed by, said facing plate and said backing plate.

* * * * *